United States Patent [19]

Audeh

[11] Patent Number: 4,759,873

[45] Date of Patent: Jul. 26, 1988

[54] ORGANIC BORON-SULFUR COMPOUNDS AND LUBRICANT COMPOSITIONS CONTAINING SAME

[75] Inventor: Costandi A. Audeh, Princeton, N.J.

[73] Assignee: Mobil Company, York, N.Y.

[21] Appl. No.: 83,473

[22] Filed: Aug. 10, 1987

[51] Int. Cl.[4] ..... C10M 135/00

[52] U.S. Cl. ..... 252/46.3; 252/49.6; 558/288; 558/298

[58] Field of Search ..... 252/46.3, 49.6; 558/288, 298

[56] References Cited

U.S. PATENT DOCUMENTS

| | | | |
|---|---|---|---|
| 2,526,506 | 10/1950 | Rogers et al. | 252/46.3 |
| 4,394,277 | 7/1983 | Small, Jr. | 252/49.6 |
| 4,465,605 | 8/1984 | Horodysky et al. | 252/46.3 |
| 4,486,323 | 12/1984 | Horodysky et al. | 252/46.3 |
| 4,492,640 | 1/1985 | Horodysky et al. | 252/49.6 |

*Primary Examiner*—William R. Dixon, Jr.
*Assistant Examiner*—Jerry D. Johnson
*Attorney, Agent, or Firm*—Alexander J. McKillop; Michael G. Gilman; Van D. Harrison, Jr.

[57] ABSTRACT

Sulfur containing diols are reacted with hydroxy boron compounds resulting in the formation of symmetrically balanced compounds which are useful as additives for lubricating oil compositions.

28 Claims, No Drawings

ORGANIC BORON-SULFUR COMPOUNDS AND LUBRICANT COMPOSITIONS CONTAINING SAME

BACKGROUND OF THE INVENTION

1. Field of the Invention

This invention relates to symmetrical boron-sulfur compounds and, more particularly, to lubricant compositions comprising oils of lubricating viscosity or greases prepared therefrom containing a wear-reducing amount of certain boron-sulfur compounds.

SUMMARY OF THE INVENTION

In accordance with this invention there is provided a lubricant composition comprising a major amount of a mineral or synthetic hydrocarbon or hydrocarboxy lubricating oil, or mixtures thereof, and a wear-reducing or hardness-enhancing amount of a boron-sulfur-organic compound of the structure

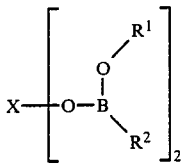

where X is a symmetrical chain containing sulfur and carbon atoms and $R^1$, and $R^2$ are chemical moities or chains which are, or are not, linked together into a cyclic configuration including the —O—B— radical. $R^1$ and $R^2$ can also be regarded as hydrocarbon radicals. The sulfur component of X is located at the mid point of the symmetrical chain if X contains a lone sulfur atom or, if X contains multiple sulfur atoms, those sulfur atoms are located at equidistant points from the center of the group of atoms in which they are contained.

DESCRIPTION OF SPECIFIC EMBODIMENTS

The structural formula for the compounds utilized in this invention is as described above.

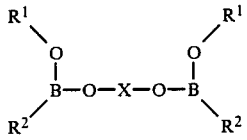

where the R group substituents are as described previously.

To produce the organic boron-sulfur compounds of this invention, compounds of the structural formula

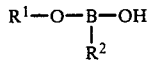

where $R^1$ and $R^2$ are alkyl radicals which are or are not linked together into a cyclic configuation are reacted with a compound of the structural formula

HO—X—OH where X is a group of carbon and sulfur atoms in which if there is one sulfur atom in the group the sulfur is located at the mid point, and if there are multiple sulfur atoms, those atoms are located at equidistant points from the center of the group of atoms in which they are contained.

Examples of suitable compounds corresponding to the hydroxy boron compounds include 10-hydroxy-10, 9-boroxarophenanthrene, and ring substituted phenanthrenes containing substituents such as methyl, methoxy, nitro, chlorine and bromine. Examples of suitable compounds corresponding to the diol-sulfur containing compound are 2,2'-thiodiethanol, 3,3'-thiodipropanol, 3,6-dithia-1,8-octanediol, and 1,4-dithiane-2,5-diol.

The reaction is carried out preferably by reacting two moles of the boron compound with one mole of the sulfur-containing diol compound.

The reaction is carried out at a temperature between 200° and 350° F. (preferably between 210° and 350° F.) and atmospheric pressure in an anhydrous organic liquid solvent such as toluene or xylene. Water resulting from the reaction is removed as it is formed as by entrainment.

In the case of a compound containing one sulfur atom the resulting product has the structural formula

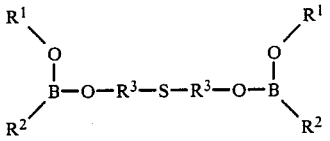

where $R^1$, and $R^2$ are groups of atoms ordinarily containing carbon atoms which are, or are not, linked together to form a cyclic group containing the —O—B— group as part of the ring structure. $R^3$ is a group of atoms ordinarily containing carbon atoms.

The resultant product is an additive which is effective in lubricant compositions for the purposes disclosed in ranges from about 0.1 to about 1.0% by weight of the total lubricant composition. A preferred concentration is 0.2 to 0.6 wt. %. In general, the additives of this invention may also be used in combination with other additive systems in conventional amounts for their known purpose. The use of additive concentrations of the compounds of this invention in premium lubricants further improves the wear-resistance of engine parts particularly bearings.

The lubricants contemplated for use herein include both mineral oil and synthetic hydrocarbon or hydrocarboxy oils of lubricating viscosity, mixtures of mineral oils and such synthetic oils, and greases prepared therefrom. The synthetic hydrocarbon oils include long chain alkanes such as cetanes and olefin polymers such as trimers and tetramers of octene and decene. These synthetic hydrocarbon oils can be mixed with other synthetic oils which include (1) ester oils such as pentaerythritol esters of monocarboxylic acids having 2 to 20 carbon atoms, (2) polyglycol ethers, and (3) polyacetals. Especially useful among the synthetic esters are those made from polycarboxylic acids and monohydric alcohols. More preferred are the ester fluids made from pentaerythritol, and an aliphatic monocarboxylic acid containing from 1 to 20 carbon atoms, or mixtures of such acids.

It will be further understood that mixtures of synthetic oils include (1) mixtures of hydrocarbon oils of varying weights, obtained either by mixing completed single hydrocarbon oils or by mixing olefins prior to oligomerization, (2) mixtures of hydrocarboxy oils, obtained generally as outlined in (1) and (3) mixtures of (1) and (2).

Having described the invention in general terms, the following examples are offered as specific illustrations thereof. It is understood they are illustrations only and that the invention is not thereby limited except as by the appended claims.

EXAMPLE 1

The symmetrical sulfur-containing diol, 2,2'-thiodiethanol $(HOCH_2CH_2)_2S$, was reacted with the organic boron compound, 10-hydroxy-10,9-boroxarophenanthrene in a ratio of one mole of the first to two moles of the latter. The boron compound has the formula:

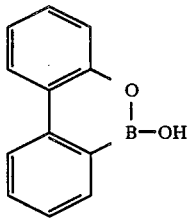

The reaction was conducted in anhydrous toluene at a temperature of about 110° C., water being removed from the reaction mixture by entrainment and condensation. The resulting compound had the structural formula

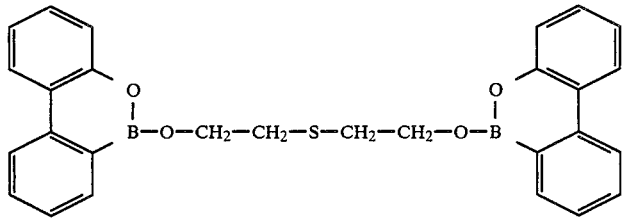

The compound had a melting point of 146° C. The carbon, sulfur and boron content of the compound when analyzed corresponded to that of the structural formula shown above.

EXAMPLE 2

The symmetrical sulfur containing diol 3,6-dithia-1,8-octanediol $[HO—CH_2—CH_2—S—CH_2]_2$ was reacted with 10-hydroxy-10,9-boroxarophenanthrene in a ratio of 1 mole of the first to 2 moles of the latter. The reaction medium was anhydrous xylene and water of reaction was removed by entrainment and condensation. The resulting compound had the following structural formula:

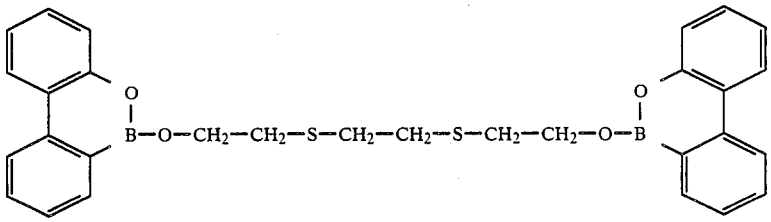

The melting point of the compound was 136° C. A carbon, sulfur, boron analysis of the compound corresponded to the compound shown above.

The compound prepared in Example 1 was added to a lubricating oil base stock in a concentration of between 0.01 and 0.05 pounds per gallon and tested in the lubrication of tapered steel roller bearings. After the bearings had been tested in use for approximately 200 hours, the hardness of the bearings was measured. Steel bearings exposed to the lubricant composition had a hardness of 1280 as measured by the Knoop Hardness Method.

Following the procedure of the preceding paragraph, the compound prepared in Example 2 was also tested. Steel bearings exposed to the lubricant had a hardness of 1100 as measured by the Knoop Hardness Method.

Examples 1 and 2 were repeated using a lubricant without any of the compounds of Examples 1 or 2 present. After approximately 200 hours the bearings were tested for hardness and it was determined that the hardness as measured by the same Knoop Method was only about 825.

These examples thus show that the hardness of the steel tapered roller bearings in particular increases upon using compounds prepared as disclosed herein.

What is claimed is:

1. The compound resulting from the reaction of a sulfur-containing diol compound having the structural formula $$HO—X—OH$$

where X is a symmetrical group of atoms containing carbon and sulfur atoms, and the sulfur component of X is located at the mid point of the symmetrical chain if X is a lone sulfur atom or, if X contains more than one sulfur atom those sulfur atoms are located at equidistant points from the center of the group, with 10-hydroxy-10,9-boroxarophenanthrene.

2. The compound of claim 1 wherein the sulfur containing diol is 2,2'-thiodiethanol.

3. The compound of claim 1 wherein the sulfur containing diol compound is 3,6-dithia-1,8-octane diol.

4. The compound of claim 1 wherein the sulfur-containing diol is 3,3'-thiodipropanol.

5. The compound of claim 1 wherein the sulfur-containing diol is 1,4-dithiane-2,5,-diol.

6. The compound comprising

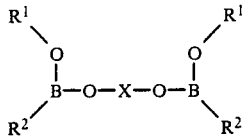

where $R^1$ and $R^2$ are hydrocarbon radicals which are or are not linked into a cyclic configuration, X is a symmetrical group of atoms containing sulfur and carbon atoms, and the sulfur component of X is located at the mid point of the symmetrical chain if X is a lone sulfur atom or, if X contains more than one sulfur atom those sulfur atoms are located at equidistant points from the center of the group.

7. The compound of claim 6 wherein the two

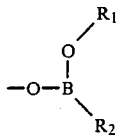

radicals are mirror images of each other.

8. The compound

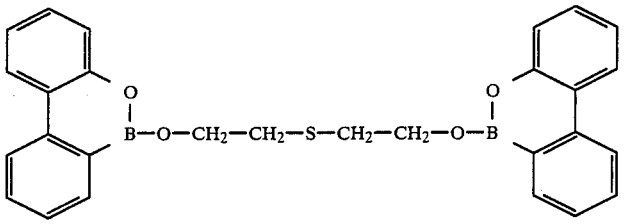

9. The compound

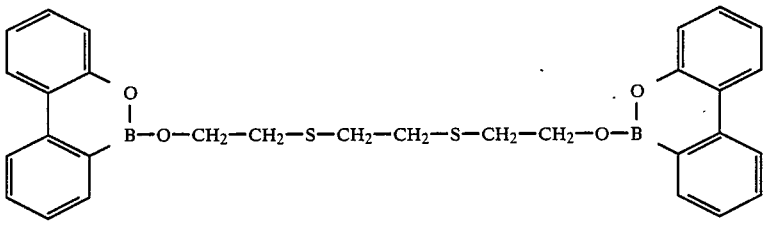

10. A lubricating composition comprising a liquid hydrocarbon lubricant and between about 0.1 and about 1.0% by weight of the total lubricant composition of the compound of claim 1.

11. A lubricating composition comprising a liquid hydrocarbon lubricant and between about 0.01 and about 1.0% by weight of the total lubricant composition of the compound of claim 2.

12. A lubricating composition comprising a liquid hydrocarbon lubricant and between about 0.01 and about 1.0% by weight of the total lubricant composition of the compound of claim 3.

13. A lubricating composition comprising a liquid hydrocarbon lubricant and between about 0.01 and about 1.0% by weight of the total lubricant composition of the compound of claim 4.

14. A lubricating composition comprising a liquid hydrocarbon lubricant and between about 0.01 and about 1.0% by weight of the total lubricant composition of the compound of claim 5.

15. A lubricating composition comprising a liquid hydrocarbon lubricant and between about 0.01 and about 1.0% by weight of the total lubricant composition of the compound of claim 6.

16. A lubricating composition comprising a liquid hydrocarbon lubricant and between about 0.01 and about 1.0% by weight of the total lubricant composition of the compound of claim 7.

17. A lubricating composition comprising a liquid hydrocarbon lubricant and between about 0.01 and about 1.0% by weight of the total lubricant composition of the compound of claim 8.

18. A lubricating composition comprising a liquid hydrocarbon lubricant and between about 0.01 and about 1.0% by weight of the total lubricant composition of the compound of claim 9.

19. The lubricating composition of claim 10 wherein the hydrocarbon lubricant selected from the group consisting of mineral oil, synthetic oil.

20. A method for increasing the hardness of a steel surface comprising lubricating said surface with a lubricating composition comprising:

a. a lubricating oil, and;

b. a boron- and sulfur-containing additive comprising the composition prepared by reacting 10-hydroxy-10,9-boroxarophenanthrene with a sulfur-containing diol compound of the formula:

HO—X—OH where x is a symmetrical group of atoms containing carbon and sulfur atoms, and the sulfur component of X is located at the mid point of the symmetrical chain if X is a lone sulfur atom or, if X contains more than one sulfur atom those sulfur atoms are located at equidistant points from the center of the group.

21. The method of claim 20 wherein said sulfur-containing diol is 2,2'-thiodiethanol.

22. The method of claim 20 wherein said sulfur-containing diol is 3,6-dithia-1,8-octane diol.

23. The method of claim 20 wherein said sulfur-containing diol is 3,3'-thiodipropanol.

24. The method of claim 20 wherein said sulfur-containing diol is 1,4-dithiane-2,5,-diol.

25. The method of claim 20 wherein said boron- and sulfur-containing additive for increasing hardness is the compound,

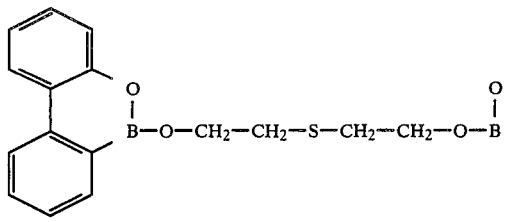

26. The method of claim 20 wherein said boron- and sulfur-containing additive for increasing hardness is the compound,

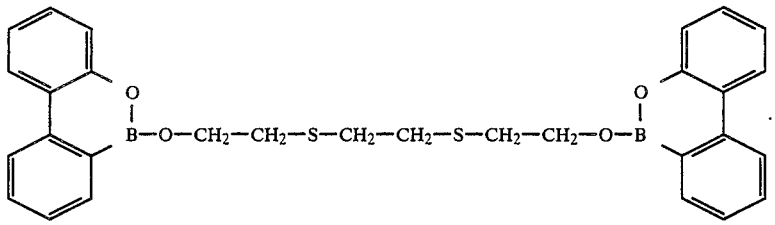

27. A process for preparing the reaction product of a sulfur-containing diol compound with a hydroxy boron compound comprising reacting a phenanthrene selected from the group consisting of 10-hydroxy-10, 9-boroxarophenanthrene, and ring substituted phenanthrenes containing methyl, methoxy, nitro, chlorine or bromine substituents with a sulfur-containing diol compound selected from the group consisting of 2,2'-thiodiethanol, 3,3'-thiodipropanol, 3,6-dithia-1,8-octanediol and 1,4-dithiane-2,5-diol.

28. The method of claim 20 wherein said boron- and sulfur-containing additive for increasing hardness is the compound of the structural formula:

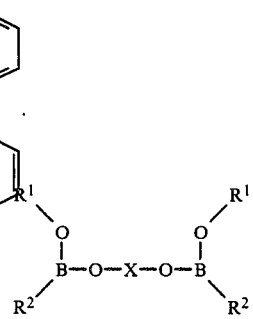

where $R^1$ and $R^2$ are hydrocarbon radicals which are or are not linked into a cyclic configuration, X is a symmetrical group of atoms containing sulfur and carbon atoms, and the sulfur component of X is located at the mid point of the symmetrical chain if X is a lone sulfur atom or, if X contains more than one sulfur atom those sulfur atoms are located at equidistant points from the center of the group.

* * * * *